United States Patent [19]

King et al.

[11] 4,113,609

[45] Sep. 12, 1978

[54] MAGNETIC CAN SORTER

[75] Inventors: Charles A. King, Vienna, Va.; Robert P. Gutterman, Bethesda, Md.

[73] Assignee: General Kinetics, Incorporated, Rockville, Md.

[21] Appl. No.: 716,285

[22] Filed: Aug. 20, 1976

[51] Int. Cl.[2] ..... B07C 5/34

[52] U.S. Cl. ..... 209/609; 209/562; 324/261; 324/251

[58] Field of Search ..... 209/81 A, 111.8, 81 R; 324/34 R, 34 PL, 42, 45; 198/690

[56] References Cited

U.S. PATENT DOCUMENTS

| | | | |
|---|---|---|---|
| 3,033,367 | 5/1962 | Gumpertz | 209/111.8 |
| 3,120,891 | 2/1964 | Cmiel | 198/690 |
| 3,525,041 | 8/1970 | Velsink | 324/45 X |

*Primary Examiner*—Allen N. Knowles

*Assistant Examiner*—Joseph J. Rolla

*Attorney, Agent, or Firm*—Cushman, Darby & Cushman

[57] ABSTRACT

Sidewalls of cans from one filling and closing line are magnetized to provide each with a north pole oriented toward the can top. Sidewalls of cans from another filling and closing line are magnetized to provide each with a south pole oriented toward the can top. These tagged cans are randomly merged into one line for further processing without mixing up can top orientations, for instance, for cooking in a conveyor-fed continuous cooker in order to keep the cooker operating nearer full capacity. Then, each can passes a magnetic sensing station where one (top) end of each can is investigated by a probe which senses whether that end is a north pole or a south pole. The sensing station commands a diverter downstream which shunts the cans sensed as having north pole ends into a different line from the cans sensed as having south pole ends.

23 Claims, 4 Drawing Figures

Fig. 2.
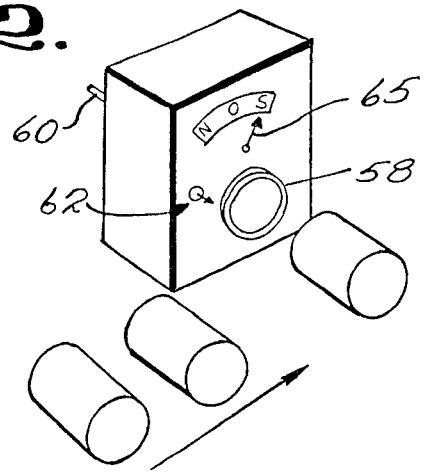
Fig. 4.
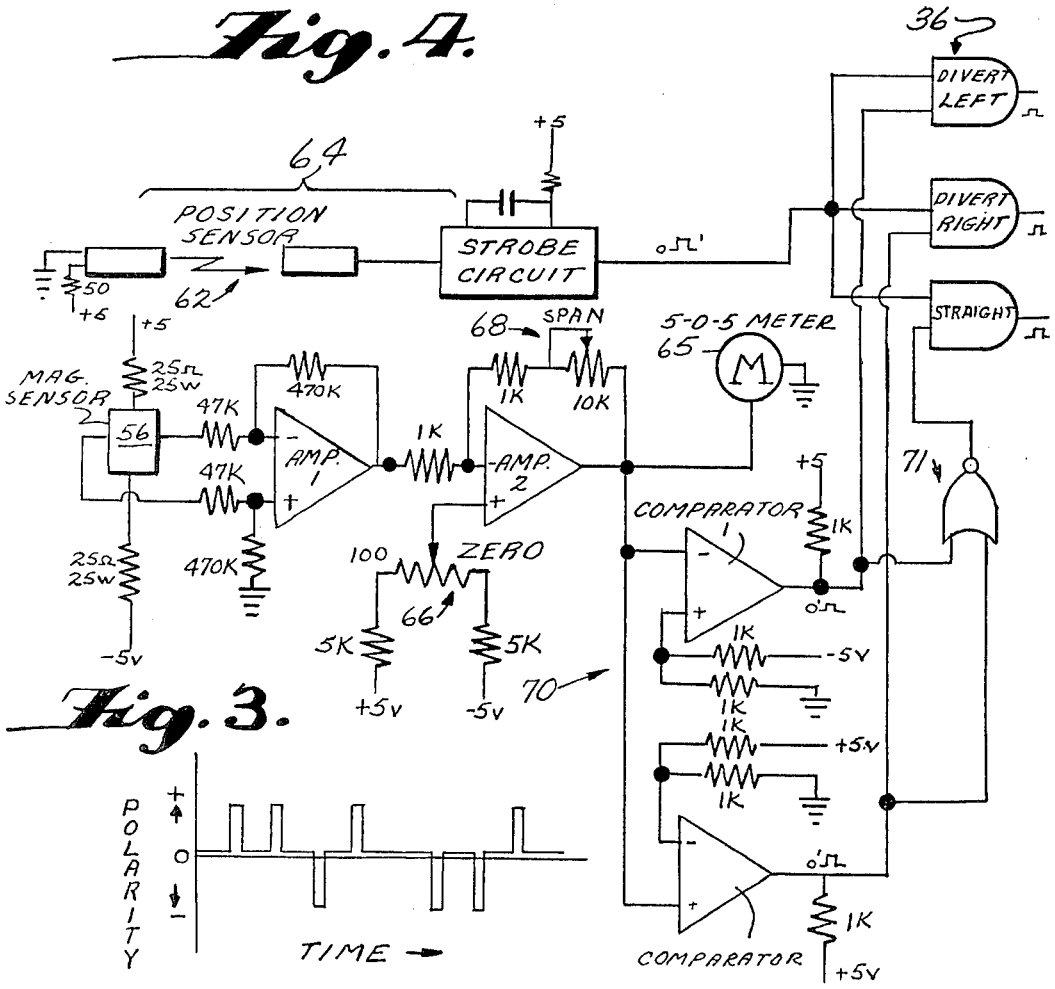
Fig. 3.

MAGNETIC CAN SORTER

BACKGROUND OF THE INVENTION

Until a few years ago, most commercial canners practiced batch-wise cooking of canned foods.

Then conveyor-fed continuous cookers were developed and marketed, principally by FMC Corporation.

A typical continuous cooker accepts one continuous row of filled and sealed but unlabeled cans, rolls the cans on their sides in a helix extending from end to end on the cylindrical inner surface of a drum while applying heat to the cans, e.g. using high-pressure steam.

The cans which have passed through the cooker are then typically cooled, palleted and warehoused. When the canner receives an order to ship, the palleted cans are withdrawn from storage, labeled with the desired labeling, boxed and shipped.

Generally, a continuous cooker is configured to process one uniform size of can, for instance 303 × 404, one pound cans and substantial modifications are needed to switch can size. However, these continuous cookers are able to cook canned food quite rapidly, so rapidly in fact that generally two or more can filling and closing lines must serve one continuous cooker if the continuous cooker is to be run near full capacity.

As a typical example, many filling and closing lines processing one pound food cans operate at an output rate of about 200 to 250 cans per minute, whereas a typical continuous cooker has an operating capacity of 600 1 pound cans per minute. Thus, either such a continuous cooker must be fed by 2 or 3 can filling and closing lines, or run with a full volume of steam wastefully cooking only a few cans and a lot of empty space, or run in a batch-wise manner.

The economics of commercial canning is such that both running a continuous cooker part full or as a batch-wise cooker is a losing proposition for both money and energy.

For the typical large volume canner and for the typical small volume canner, the problem just outlined is unlikely to arise.

The large volume canner can expect to be packing so much of one sort of food that it is feasible to feed their continuous cooker using two, three or several filling and closing lines each putting the same kind and grade of food in the same cans.

The small volume canner lacks the expectation of being able to fully use a continuous cooker. Thus, such a unit is generally not part of a small canner's equipage.

The problem of using a continuous cooker efficiently and profitably is most likely to arise for a medium volume canner. Such a canner may have operational peaks during which a continuous canner can be served by a plurality of filling and closing lines all processing the same kind and quality of food. However, at other times the volume or anticipated length of run may be insufficient to warrent operating more than one filling and sealing line to process a particular kind and quality of food.

Faced with that potential, some medium-sized canners have acquired continuous cookers, used them efficiently at times and inefficiently at other times and have hoped increasing business volume would improve their efficiency. Other medium-sized canners have simply put off acquiring continuous cookers, despite their obvious advantages.

While a medium-sized canner may not have the volume of one kind and quality of food to run several filling and sealing lines at once to can that food, it is likely to have sufficient business volume to be running two or more filling and sealing lines at once, each processing a different kind and/or quality of food. For instance, one line might be packing Grade A peas and another might be packing Grade B peas, or one might be packing cream-style corn while the other is packing whole-kernel corn.

Prior to the present invention, others have made some efforts to find an acceptable way to serve a continuous cooker with the randomly mixed output of a plurality of filling and sealing lines that are processing foods of a different kind or quality. Basically, these efforts have centered about marking the cans from each line in an optically sensible manner. These are examples of what has been tried: brass-colored lids on one line's cans and silver-colored lids on the other line's cans; spots of highly reflective paint applied to the cans of one line, but not to those of the other; and different product codes embossed on the can lids. Sensing devices have ranged from simple brightness detectors through complex optical character readers.

However, all these optical techniques have a common problem: at the point in the process where the mixed cans are to be separated, the cans most often are covered with beads of moisture, because they have just gone through a cooling spray and/or because they have cooled below the dew point of their environment and condensation has occurred thereon. Simply put, the moisture beads reflect light in a sufficiently unpredictable manner as to introduce an unacceptable level of uncertainty in a discrimination based on optical cues.

These prior art systems have other undesirable features. Odd-colored lids are unacceptable to some of the canners' customers and to some ultimate consumers. Their use requires the canners to stock two or more colors of lids and to avoid mistakes in supplying the right color of lids to each canning line. Applied spots of paint or the like require spot applying machinery which can become fouled or exhausted of paint resulting in a number of identically-appearing intentionally spotless and unintentionally spotless cans becoming mixed, then unsortable. In addition, processing in a cooker can remove some paint spots applied under less-than-optimum conditions such as improper composition, mixing or drying of the paint.

SUMMARY OF THE PRESENT INVENTION

The present invention was devised to provide a reliable way of tagging cans and for sorting tagged cans from a mixture of cans.

In practicing the preferred form of the invention, sidewalls of cans from one filling and closing line are magnetized to provide each with a north pole oriented toward the can top. Sidewalls of cans from another filling and closing line are magnetized to provide each with a south pole oriented toward the can top. These tagged cans are merged randomly into one line for further processing without mixing up relative can top orientations, for instance for cooking in a conveyor-fed continuous cooker in order to keep the cooker operating nearer full capacity. Then, each can passes a magnetic sensing station where one (top) end of each can is investigated by a probe which senses whether that end is a north pole or a south pole. The sensing station commands a diverter downstream which shunts the cans sensed as having north pole top ends into a different line from the cans sensed as having south pole top ends.

A particular sensing probe and system is disclosed, as are variations calling for less and more magnetizing and diversion into more than two output lines.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 2 is a schematic view of the sensing station on a larger scale;

FIG. 3 is a fragment of a typical plot of magnetic polarity versus time, representing the output signal of the sensing station; and FIG. 4 is a representative schematic circuit diagram for the can sorter.

DETAILED DESCRIPTION OF PRESENTLY PREFERRED EMBODIMENTS OF THE INVENTION

In General

Figure 1:
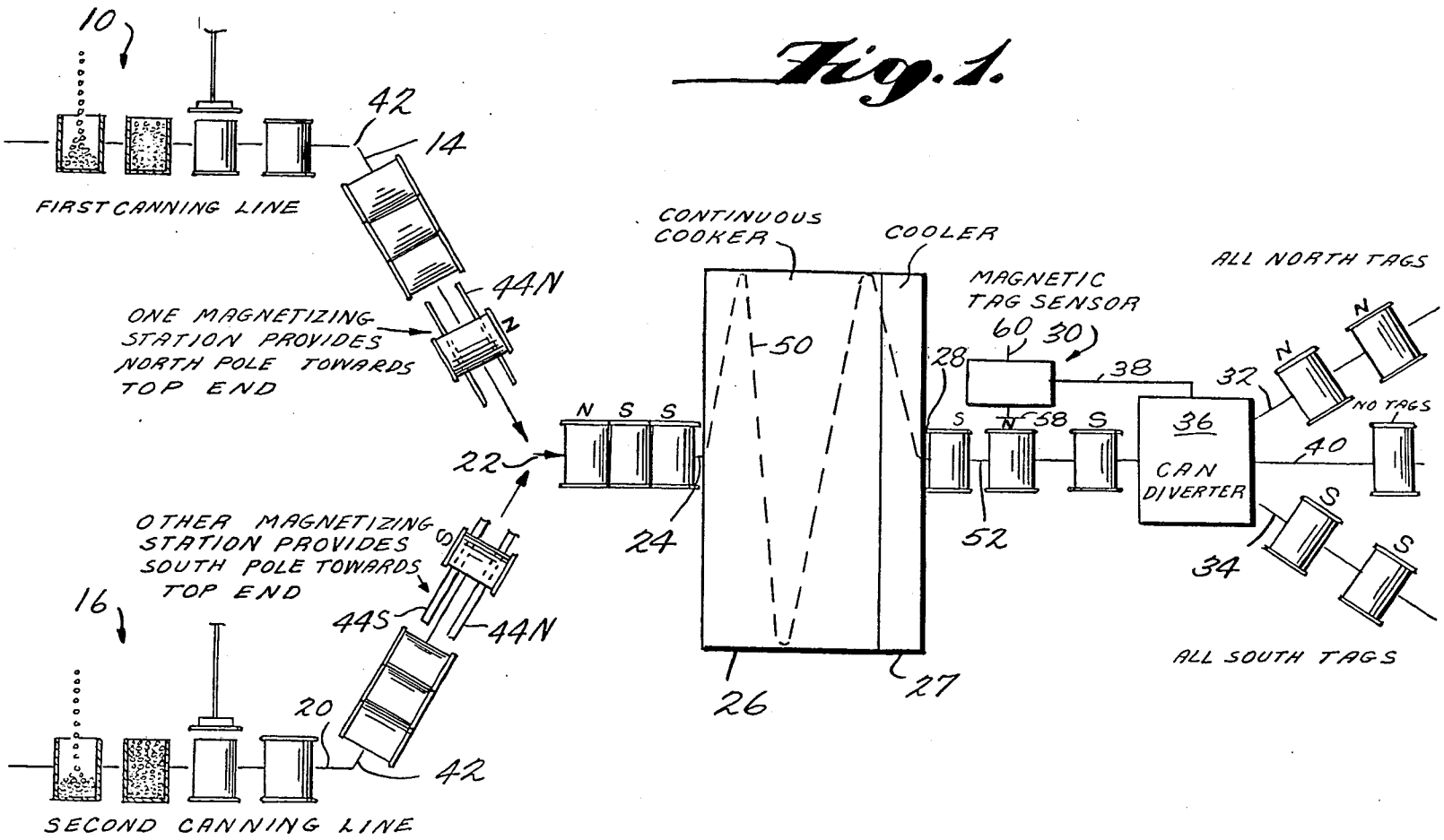
FIG. 1 is a schematic view of a food canning operation incorporating a magnetic tagging and sorting system in accordance with the principles of the present invention.

The output of one can packing line 10 is magnetically tagged at a magnetizing station 12 interposed in the output conveyor 14 of that packing line. Typically, these cans are provided with a north pole N toward the can top.

The output of another can packing line 16 is magnetically tagged at a magnetizing station 18 interposed in the output conveyor 20 of that packing line. Typically, these cans are provided with a south pole S toward the can top.

The conveyors 14 and 20 merge at 22 to provide one row of a mixture of magnetically tagged cans. A conveyor 24 feeds the can mixture to a continuous cooker 26. The cans are conveyed through the continuous cooker 26, whereupon the cans are cooled at 27 and accepted by a conveyor 28.

A magnetic sensing device 30 stationed astride the conveyor 28 examines each passing can typically for whether the can being examined is presenting a north pole or a south pole toward the sensing device.

Further downstream, the conveyor 28 splits into at least two conveyor lines 32, 34 and a conventional can diverter 36 is provided at the fork. The diverter 36 is electronically linked to the sensing device 30, for instance by wire 38, to be operated by the output signal of the sensing device.

In the instance shown, when each can sensed to have a north pole top reaches the diverter, it is shunted to the conveyor line 32, and when each can sensed to have a south pole top reaches the diverter, it is shunted to the conveyor line 34.

As also depicted, a third conveyor line 40 may be provided for untagged cans or for occasional tagged cans whose pole strength is too low to permit a discrimination to be made and relied upon.

In Particular

In order to use the invention, the canner must run cans of magnetizable material, e.g. conventional tin plate, T.F.S. or the like and not cans made of e.g. all-plastics, foil/fiber helically wound composites, or non-magnetizable aluminum alloys. However, at least at present, the structural demands for rigidity upon vacuum-packed, sealed food cans practically dictate the use of steel sheet for such cans to avoid can collapse on initial exposure to high-pressure steam and later in the cooling step after cooking.

After the cans are filled and closed in a top-end-up orientation, a conventional turning mechanism is used at 42 to place each can in a horizontal condition with all the top-ends pointed the same direction.

The magnetizing stations preferably each include a permanent magnet including a set of two rails 44N, 44S arranged side-by-side and extending longitudinally of the respective conveyors 14, 20. The rails 44N, 44S are transversely spaced apart by an amount nearly equal to the longitudinal extent of the sidewall of the size of can being processed and the rails are preferably disposed at a downward slant greater than any slant the conveyor 14 or 20 may have. The permanent magnet should be so strong as to magnetize each can to saturation parallel to the can length.

The rails 44N, 44S are preferably sufficiently long that each can which reaches the rails and rolls down their slant undergoes at least one complete revolution while rolling on the rails.

Generally the cans are closely packed on the conveyors 14 and 20, but acceleration on the slanting rails causes each can, while it is being magnetized, to become spaced apart from its neighbors in the row.

One might ask, why not just magnetize a flat end of each can rather than the cylindrical sidewall. One reason for the sidewall choice is the widespread practice of canning companies of using magnetically assisted conveyors. If, for instance, there is a substantial difference in the height of the cooker 26 inlet and the packing lines 10 or 16, or between the cooker 26 and the end of the processing line, one or more of the conveyors 14, 20, 22, 24, 28, 32, 34 will have an inclined section. In order to keep the cans being conveyed up or down the incline from slipping, it is conventional to place magnets under or in the conveying surface to press the cans into good tractive engagement with the conveying surface. As it is, use of a magnetically assisted conveyor disturbs the polarity of the can sidewalls, but does not destroy or reverse it. However, this practice would prevent a reliable separation from being made if the can ends rather than the can sidewalls were magnetically tagged. (It is possible to successfully use tagged ends if magnetic conveyors are not used, or if only one end of each can is ever presented toward a magnetic conveyor, and it is the opposite end of each can that is magnetically tagged.)

It should be apparent that the apparatus and method of the invention can be successfully used only in instances where the top-bottom orientation of each can is not randomized at any point between the magnetizing station 12, 18 and the magnetic sensing station 30. Thus, although each can may be tipped on its side and set back upright once or several times during processing, the orientation, can-for-can remains certain so long as each can has what was its top end, when it was magnetized, presented in the same direction at the magnetic sensing station.

So far as it concerns the present invention, the main effect of magnetically aided conveying of the magnetically tagged cans is to produce local peaks and troughs in the pole strength of the magnetized cans, particularly at the can end which was presented toward the magnetically aided conveyor. Accordingly, it is desirable to present one can end toward the magnetically aided conveyor but always sense the polarity at the opposite end of the can. For instance, it may be decided, as an arbitrary convention, to sense the polarity by presenting the can top ends toward the sensing probe at the station 30, and to have magnetically conveyed the cans only while they were resting on the can bottom ends. Thus, the can magnetic pole that is most "damaged" during magnetically assisted conveying is not used for discrimination. Rather, the least "damaged" pole is sensed at station 30.

Other factors and events such as the can sidewall seam (if any), the leading and trailing ends of the magnetic rails 44N, 44S, cooking heat, banging together of cans and the like can produce minor discontinuities or variations in pole strength. In general, these are not as significant as those resulting from magnetically assisted conveying, and in no event is a north pole end changed to a south pole end or vice versa by these factors and events.

Typically, the continuous cooker 26 accepts the mixture of magnetically tagged cans in a continuous stream of cans which abut one another in a single row. The row of cans feeds into a spiral guide (indicated at 50) inside the cooker shell and roll in, or nearly in, contact with adjacent cans along the whole length of the guide 50. A spider (not shown) mounted inside the cooker presses the cans outwards into the guide. High-pressure, high-temperature steam, contained in the cooker body by suitable steam-locks heats the cans inside the cooker. The continuous rolling of the cans causes mixing and more even heat distribution within each can, speeding the cooking process.

The cans which exit the cooker 26 pass a cooling station 27 on the conveyor 28, where cool water sprays, total immersion in water, or the like cool the cans.

At the sensing station, the conveyor 28 includes a higher speed section 52 for providing a space in the order of one can diameter between adjoining cans so that the sensor can examine each can individually, with little interference from neighboring cans.

There are a number of ways magnetic sensing could be carried out at 30. For instance, a coil placed adjacent the can path and connected to a current flow magnitude and direction indicating meter would have a current induced therein by passage of magnetized cans by the coil. In practice, the strength of the indication is proportional to the speed of the cans past the coil and the necessary speed for producing sufficient induced current strength for a reliable indication is inconveniently fast.

Fortunately, there are other sensing techniques which are not dependent on speed of can travel past the sensor. The presently, preferred technique utilizes a Hall-effect sensor.

As is well known, it is possible to use a chip of some semiconductor materials as a magnetic sensor. In order to do that, a voltage is applied across two opposing edges of the chip and two other opposing edges are connected to a current flow indicating device. When the sensor is brought near a magnetized object, the vector of electron flow across the semiconductor chip is changed, producing a corresponding change in the current flow indicated by the indicating device. Instead of placing the chip itself in proximity with the magnetized body, a probe of highly permeable magnetic core material such as permalloy may be connected to the chip and brought near the magnetized object.

By preference, the probe includes a first, ring-shaped element to be brought into proximity with each can end, and a second element pointing into space away from the can. The preferred arrangement is shown in FIG. 2, in which the chip 56 of FIG. 4 is served by a ring-shaped probe 58 and a rod-shaped other element 60.

The sensing station further includes a can detector 62 subsystem for determining each point in time when the ring-shaped probe element should be taking a measurement. Typically, the can detector includes a photocell circuit 64 wherein interruption or reflection of a photocell beam cues the magnetic sensing station to make a measurement a fixed, brief time later. The object is to make the measurement when the ring-shaped probe element 58 coincides with a can end of a can being conveyed through station 30. When the ring 58 is of substantially the same diameter as the can and the measurement is taken at the point that the circular probe and can end are substantially coaxial, whatever variation there is in pole strength angularly of the can longitudinal axis, is largely averaged out by the probe.

Although the sorting device need not have a visual indicator of magnetic polarity, provided its sensor is connected in a command relation to a can diverter, a visual indicator permits easier adjustment and monitoring.

Accordingly, a visual indicator 65 is provided. It may have a conventional circuit 66 for zeroing the indicator and a span adjustment 68 for adjusting the indicator needle swing to the scale range of the instrument. In that way, for instance, sensing an ideal north pole can swing the indicator needle all the way to the right on the scale and sensing an ideal south pole can swing the indicator needle all the way to the left on the scale. The amplified, zeroed and span-adjusted signal is also electrically compared at 70. If the can has its north pole toward the probe, the diverter 36 is signalled by the comparator to divert that can to the left onto the conveyor 32 when that can reaches the diverter 36. If, instead, the can has its south pole toward the probe, the diverter 36 is signalled by the comparator to divert that can to the right. Odd cans whose sensed pole may be so damaged as to be indeterminate are shunted to a separate line 40 when they reach the diverter 36, upon detection of this anomaly at 71. In the preferred two-level system, each can sidewall is magnetized parallel to the can longitudinal axis so as to have a north pole toward one end of each can of one grade or quality of contents and a south pole toward the same end of each can of a second grade or quality of contents and the magnetic sorter simply looks for north ends and south ends. However, a somewhat less reliable two-level system could be run wherein only one of the two incoming streams of cans is magnetically tagged, either all north or all south, and the sorter looks for such tags. In that event, the discrimination process separates the cans by whether they are tagged or untagged. Such a variation is less reliable because only about half the magnitude of difference exists between the pole strength of an ideally tagged can and an ideally untagged can and pole damage can more easily result in some weakened tag cans being sorted with untagged cans. Of course, a minor amount of such mis-sorting can be tolerated if the food in both tagged and untagged cans is of the same kind, but that in the untagged cans is of a lesser grade, since the net result of a sorting error is, e.g. to put a can of Grade A peas in with the cans of Grade B peas and lose the incremental value of its true grade.

Similarly, a three-level system can be run by integrating a line of north tagged cans, a line of south tagged cans and a line of untagged cans. Sensing and diverting is performed as with the preferred embodiment, except that a third class of cans will wind up on conveyor 40. For the same reasons as explained in regard to the just-described one tagged/one untagged two-level system, use of such a three-level system is best confined to instances where no great liability is caused by the occasional mis-sorting of a tagged can into the untagged group. An instance where such a three-level system could be used is where one filling and closing line is processing Grade A Fancy peas, a second line is processing Grade B peas and the third line is processing the lowest grade of peas. If the cans with the lowest grade of peas are the untagged ones, any mis-sorting is much more likely to shunt a can of Grade A Fancy or Grade B peas on to the conveyor for cans of lowest grade peas to the same, tolerable result as described with relation to the second two-level variation.

Notice that the system just described is insensitive to whether the cans are hot or cold, wet or dry, light or dark, labeled or unlabeled and that the sensing is largely insensitive to the speed of travel of the cans through the sensing station. Accordingly, the system described overcomes problems in the art, is straightforward, easy and economical to use.

It should now be apparent that the magnetic can sorter, as described hereinabove, possesses each of the attributes set forth in the specification under the heading "Summary of the Invention" hereinbefore. Because the magnetic can sorter can be modified to some extent without departing from the principles of the invention as they have been outlined and explained in this specification, the present invention should be understood as encompassing all such modifications as are within the spirit and scope of the following claims.

What is claimed is:

1. A magnetic can sorting method, comprising:

(a) filling and closing cans in a first line;

(b) filling and closing cans in a second line;

(c) magnetically tagging each can from the first line with a like sense of polarity, and not likewise tagging the cans from the second line thereby providing a basis for discriminating between cans originating in the first and second line; in step (c) the sidewall of each can from the first line being magnetized in a sense which provides a north pole adjacent the same one end of each can from the first line, and a south pole adjacent the same opposite end of each can from the first line;

(d) after performing step (c), merging the cans from the first and second lines into a common group;

(e) performing at least one processing or transporting step in common upon the common group of cans;

(f) examining each can for the presence of said like sense of polarity;

in step (f) a like end of each can being moved into proximity with an electrical conductor whose electrical conductivity is substantially affected by the proximity and orientation of a magnetic field but not by the velocity of each can relative to the conductor; and the examining step includes sensing whether change in conductivity of the electrical conductor is characteristic of that produced by proximity of a can tagged with said like sense of polarity;

in moving each can into proximity with an electrical conductor, said like end of each can is brought into proximity with a ring-shaped probe element of the electrical conductor, the ring-shaped probe having substantially the same diameter as the can and each examination being made at the respective moment when each respective can is substantially in coaxial registry with the probe;

and on the basis of such exmination:

(g) sorting the common group of cans into a first sort consisting of cans having said like sense of plarity and a second sort consisting of cans not having said like sense of polarity.

2. The magnetic can sorting method of claim 1, wherein:

in steps (a) and (b) the cans are filled with food; and in step (e) the food is cooked within the cans.

3. The magnetic can sorting method of claim 1, wherein:

steps (a) through (g) are conducted continuously while each can is moved through the succession of said steps, without losing its spatial orientation relative to neighboring ones of said cans between steps (c) and (f).

4. The magnetic can sorting method of claim 1, wherein:

in step (c), each can from the first line is turned on its side and rolled along its sidewall through at least one complete revolution along a magnet having north and south poles thereof spaced transversely of the direction of this rolling.

5. The magnetic can sorting method of claim 1, wherein:

in moving each can into proximity with an electrical conductor probe, each can is moved into proximity with the probe of a Hall-effect semiconductor device.

6. The magnetic can sorting method of claim 1, wherein:

in the course of performing steps (d) and (e), each can is conveyed for at least a short distance, while supported on an end thereof, upon a magnetically aided conveyor that is insufficiently strong to create, negate or reverse can tagging of said like sense of polarity, sensible at the can end opposite the can end supported on the magnetically aided conveyor; and in conducting step (f) the can end opposite the can end that was supported on the magnetically aided conveyor is selected to be said like end of each can.

7. The magnetic can sorting method of claim 1, wherein:

step (g) is performed by an automatic can diverter; and the automatic can diverter is operated by response to presence and absence of sensation of said characteristic change in conductivity to shunt the cans for which said sensation is present in one direction and to shunt the cans for which said sensation is absent in another direction.

8. The magnetic can sorting method of claim 7, wherein:

the cans shunted in said one direction are shunted onto one conveyor path; and the cans shunted in said other direction are shunted onto another conveyor path.

9. A magnetic can sorting method, comprising:

(a) filling and closing cans in a first line;

(b) filling and closing cans in a second line;

(c) magnetically tagging each can from the first line with a first, like sense of polarity;

in step (c) the sidewall of each can from the first line being magnetized in a sense which provides a north pole adjacent the same one end of each can from the first line and a south pole adjacent the same opposite end of each can from the first line;

(d) magnetically tagging each can from the second line with a second, like sense of polarity that is substantially different from said first, like sense of polarity, thereby providing a basis for discriminating between cans originating in the first and second line;

in step (d) the sidewall of each can from the second line being magnetized in the opposite sense to provide a south pole adjacent the same one end of each can from the second line and a north pole adjacent the same opposite end of each can from the second line;

(e) after performing steps (c) and (d), merging the cans from the first and second lines into a common group;

(f) performing at least one processing or transportation step in common upon the common group of cans;

(g) examining each can for the sense of polarity thereof;

in step (g) a like end of each can being moved into proximity with an electrical conductor whose electrical conductivity is substantially affected by the proximity and orientation of a magnetic field but not by the velocity of each can relative to the conductor; and the examining step includes sensing whether change in conductivity of the electrical conductor is characteristic of that produced by proximity of a can tagged with said first, like sense of polarity or characteristic of that produced by proximity of a can tagged with said second, like sense of polarity;

in moving each can into proximity with an electrical conductor, said like end of each can is brought into proximity with a ring-shaped probe element of the electrical conductor, the ring-shaped probe having substantially the same diameter as the can and each examination being made at the respective moment when each respective can is substantially in coaxial registry with the probe;

and on the basis of such examination:

(h) sorting the common group of cans into a first sort consisting of cans having said first, like sense of polarity and a second sort consisting of cans having said second, like sense of polarity.

10. The magnetic can sorting method of claim 9, wherein:

in steps (a) and (b) the cans are filled with food; and in step (f) the food is cooked within the cans.

11. The magnetic can sorting method of claim 9, wherein:

steps (a) through (h) are conducted continuously while each can is moved through the succession of said steps, without losing its spatial orientation relative to neighboring ones of said cans between steps (c) and (g).

12. The magnetic can sorting method of claim 9, wherein:

in step (c) and in step (d) each respective can is turned on its side and rolled along its sidewall through at least one complete revolution along a magnet having north and south poles thereof spaced transversely of the direction of this rolling.

13. The magnetic can sorting method of claim 9, wherein:

in moving each can into proximity with an electrical conductor probe, each can is moved into proximity with the probe of a Hall-effect semiconductor device.

14. The magnetic can sorting method of claim 9, wherein:

in the course of performing steps (e) and (f), each can is conveyed for at least a short distance, while supported on an end thereof, upon a magnetically aided conveyor that is insufficiently strong to create, negate or reverse can tagging of the respective like sense of polarity, sensible at the can end opposite the can end supported on the magnetically aided conveyor; and in conducting step (g) the can end opposite the can end that was supported on the magnetically aided conveyor is selected to be said like end of each can.

15. The magnetic can sorting method of claim 9, wherein:

step (h) is performed by an automatic can diverter; and the automatic can diverter is operated by response to presence of sensation of said characteristic change in conductivity to shunt the cans for which the sensation corresponding to the first, like sense of polarity is present in one direction and to shunt the cans for which the sensation corresponding to the second, like sense of polarity is present in another direction.

16. The magnetic can sorting method of claim 15, wherein:

the cans shunted in said one direction are shunted onto the conveyor path; and the cans shunted in said other direction are shunted onto another conveyor path.

17. Apparatus for use in a magnetic can sorting system, comprising:

(a) a first filling and closing line for cylindrical cans of food;

(b) a second filling and closing line for cylindrical cans of food;

(c) means for longitudinally magnetically tagging each can from the first line with a like sense of polarity which provides a north pole adjacent the same one end of each can from the first line, and a south pole adjacent the same opposite end of each can from the first line;

(d) means conveying the tagged cans from the first filling and closing line and the cans from the second filling and closing line into a common group;

(e) a continuous cooker for cooking the food in the cans of said common group;

(f) conveyor means for conveying the cans of said common group into through and from the continuous cooker;

(g) means for examining each can of cooked food for the presence of said like sense of polarity;

the examining means including an electrical conductor, the electrical conductivity of which is substantially affected by the proximity and orientation of a magnetic field but not by the velocity of each can relative to the conductor;

means for passing an electrical current along said electrical conductor; and means for sensing whether a change in conductivity of the electrical conductor as a can is brought into proximity therewith is characteristic of that produced by proximity of a can tagged with said like sense of polarity;

the electrical conductor being one having a ring-shaped probe of highly magnetically permeable material with a diameter substantially equal to the diameter of the can ends to be examined; and further including means responsive to the approach of a can to the ring-shaped probe for limiting the time when each examination is conducted to the time when each can is substantially in coaxial registry with the ring-shaped probe; and (h) means for sorting the common group of cans on the basis of said examining, into a first sort consisting of cans having said like sense of polarity and a second sort consisting of cans not having said like sense of polarity.

18. The apparatus of claim 17, wherein the means for sorting comprises:

an automatic can diverter; and means for operating the automatic can diverter in response to presence and absence of sensation of said characteristic change in conductivity to shunt the cans for which said sensation is present in one direction and to shunt the cans for which said sensation is absent in another direction.

19. The apparatus of claim 17, wherein the magnetic tagging means includes:

a permanent magnet having a raised north pole rail and a raised south pole rail, which extend generally parallel to one another throughout a length that is at least equal to the developed length of circumference of the sidewalls of the cans to be processed thereby; and said rails being transversely spaced apart by an amount nearly equalling the distance between the ends of the cans to be processed thereby; whereby as each can is rolled on its sidewall along said rails the can sidewall becomes magnetized to have a north pole adjacent one can end and a south pole adjacent the opposite can end.

20. The apparatus of claim 19, further including: means supporting the rails at a downward slant sufficiently great as to permit cans placed at the high end of the rails to roll down to the low end of the rails under the influence of gravity.

21. Apparatus for use in a magnetic can sorting system, comprising:

a permanent magnet having a raised north pole rail and a raised south pole rail, which extend generally parallel to one another throughout a length that is at least equal to the developed length of circumference of the sidewalls of the cans to be processed thereby;

said rails being transversely spaced apart by an amount nearly equalling the distance between the ends of the cans to be processed thereby; and means supporting the rails at a downward slant sufficiently great as to permit cans placed at the high end of the rails to roll down to the low end of the rails under the influence of gravity; whereby;

as each can is rolled on its sidewall along said rails the can sidewall becomes magnetized to have a north pole adjacent one can end and a south pole adjacent the opposite can end.

22. A magnetic can sorting system, comprising:

an automatic can diverter for shunting an incoming supply of cans into at least two different sorts; and can relative velocity-insensitive means for examining one end of each incoming can, upstream from the diverter, for the presence of magnetism of at least one particular sense of polarity;

the examining means including an electrical conductor, the electrical conductivity of which is substantially affected by the proximity and orientation of a magnetic field but not by the velocity of each can relative to the conductor;

means for passing an electrical current along said electrical conductor; and means for sensing whether a change in conductivity of the electrical conductor as a can is brought into proximity therewith is characteristic of that produced by proximity of a can tagged with said like sense of polarity;

the electrical conductor being one having a ring-shaped probe of highly magnetically permeable material with a diameter substantially equal to the diameter of the can ends to be examined; and further including means responsive to the approach of a can to the ring-shaped probe for limiting the time when each examination is conducted to the time when each can is substantially in coaxial registry with the ring-shaped probe; and means for operating the automatic can diverter in response to said examining, to divert into one sort the cans sensed to possess said magnetism of said one particular sense of polarity and to divert into another sort the cans sensed to lack said magnetism of said one particular sense of polarity.

23. For use in combination with an automatic can diverter capable of shunting an incoming supply of cans into at least two different sorts, a magnetic can sorting device, comprising: can relative velocity-insensitive means for examining one end of each incoming can, upstream from the diverter, for the presence of magnetism of at least one particular sense of polarity;

the examining means including an electrical conductivity of which is substantially affected by the proximity and orientation of a magnetic field but not by the velocity of each can relative to the conductor;

means for passing an electrical current along said electrical conductor; and means for sensing whether a change in conductivity of the electrical conductor as a can is brought into proximity therewith is characteristic of that produced by proximity of a can tagged with said like sense of polarity;

the electrical conductor being one having a ring-shaped probe of highly magnetically permeable material with a diameter substantially equal to the diameter of the can ends to be examined; and further including means responsive to the approach of a can to the ring-shaped probe for limiting the time when each examination is conducted to the time when each can is substantially in coaxial registry with the ring-shaped probe;

and means for operating the automatic can diverter in response to said examining, to divert into one sort the cans sensed to possess said magnetism of said one particular sense of polarity and to divert into another sort the cans sensed to lack said magnetism of said one particular sense of polarity.

* * * * *